US006113250A

United States Patent [19]

Lin

[11] Patent Number: 6,113,250

[45] Date of Patent: Sep. 5, 2000

[54] PROTECTING DEVICE OF A DESK LAMP

[76] Inventor: Jack Lin, No. 21, Alley 9, Lane 27, Sec. 5, Min Sheng E. Rd., Taipei, Taiwan

[21] Appl. No.: 09/184,554

[22] Filed: Nov. 2, 1998

[51] Int. Cl.[7] ..... F21S 1/12

[52] U.S. Cl. ..... 362/287; 362/413; 362/414; 362/427

[58] Field of Search ..... 362/413, 414, 362/287, 427, 419, 263

[56] References Cited

U.S. PATENT DOCUMENTS

| | | | |
|---|---|---|---|
| 5,176,443 | 1/1993 | Lin | 362/413 |
| 5,265,000 | 11/1993 | Lin | 362/413 |
| 5,396,409 | 3/1995 | Cvek | 362/413 |
| 5,477,443 | 12/1995 | Cvek | 362/413 |

*Primary Examiner*—Thomas M. Sember
*Attorney, Agent, or Firm*—Rosenberg, Klein & Lee

[57] ABSTRACT

A protecting device of a desk lamp comprises a seat, two clamping pieces, two parallel telescopic rods, an insulating stopper, a covering plate, a filament, a transformer, etc. A guide groove is formed on the seat. Each of the two sides of the guide groove is installed with a respect fixing rod. The lower end of one of the fixing rods is pivotally locked with a first ring. The upper ends of the fixing rods are pivotally connected with two conducted parallel telescopic rods. The upper ends of the two telescopic rods are connected with a lamp head and an insulating stopper is connected with the two telescopic rods. Two sets of trenches are installed on the bottom of the guide groove so that two clamping pieces are engaged thereon from the seat. Each of the clamping pieces is installed with a receiving portion. Each of the receiving portions is installed with a receiving hole. One of the receiving hole is locked into a second ring. Another receiving hole is locked on the lower end of another fixing rod. One side of each receiving hole is installed with a pair of adjacent guide pieces. A filament is installed between the two clamping pieces and a cover plate is connected on the opening of the guide groove. A transformer is installed within the seat. One of the primary sides of the transformer is connected with a fixing piece ring and another primary side is connected with a second ring. When the two telescopic rods are shorted by an intentional action, the filament is burnt out, thus the transformer is prevented to burn.

7 Claims, 9 Drawing Sheets

PROTECTING DEVICE OF A DESK LAMP

BACKGROUND OF THE INVENTION

1. Field of the Invention

The present invention relates to a protecting device of a desk lamp, and especially to an improved structure of a two rods type lamp, wherein unintentional destruction is avoided and therefore, the transformer therein is protected.

2. Description of the Prior Art

FIG. 1 shows a prior art two rods type lamp, wherein two conductive telescopic rods 60 and 65 are used as a supporting frame of the lamp. The upper ends of the telescopic rods 60, 65 are connected with the lamp head 70. The lower ends of the telescopic rods are connected with a transformer within the seat 80 so to form a lamp with a telescopic supporting frame. The primary end of the transformer is connected with a power line which can supply power to a bulb (not shown) through the transformer. Also, an insulating stopper 85 is installed between the two telescopic rods 60, 65 for preventing the contact of the two telescopic rods 60, 65 during twisting.

However, the twisting angle of the two telescopic rods 60 and 65 is limited within a certain angle so as to prevent the two telescopic rods from contacting each other. But if someone intentionally twists the telescopic rods, for instance, they may be forced into contact with each other. Therefore, this easily leads to the transformer burning burn out.

Therefore, there is a need for a novel lamp with two telescopic rods which can prevent a short circuit due to unintentional destructive contact thereof.

SUMMARY OF THE INVENTION

Accordingly, the object of the present invention being to provide an improved structure of a protecting device of a desk lamp which can avoid unintentional destruction, the desk lamp of the present invention comprises a seat, two clamping pieces, two parallel telescopic rods, an insulating stopper, a covering plate, a filament, a transformer, etc. A guide groove is formed on the seat. Each of the two sides of the guide groove is installed with a respective fixing rod. The lower end of a first of the fixing rods is pivotally locked with a first ring. The upper ends of the fixing rods are pivotally connected with two conductive parallel telescopic rods. The upper ends of the two telescopic rods are connected with a lamp head and an insulating stopper is connected with the two telescopic rods. Two sets of trenches are installed on the bottom of the guide groove so that two clamping pieces are engaged thereon from the seat. Each of the clamping pieces is formed with a receiving portion. Each of the receiving portions is formed with a receiving hole. One of the receiving holes is locked with a second ring. Another receiving hole is locked on the lower end of a second fixing rod. One side of each clamping piece is formed with a pair of adjacent guide piece. A filament is installed between the two clamping pieces and a cover plate is connected on the opening of the guide groove. A transformer is installed within the seat. One of the primary end of the transformer is connected with a first ring and another of the primary ends is connected with a second ring. When the two telescopic rods are shorted by unintentional action, the filament is burnt out, thus the transformer is prevented from burning.

The present invention will be better understood and its numerous objects and advantages will become apparent to those skilled in the art by reference to the following drawings in which:

DETAILED DESCRIPTION OF THE PREFERRED EMBODIMENT

Figure 1:
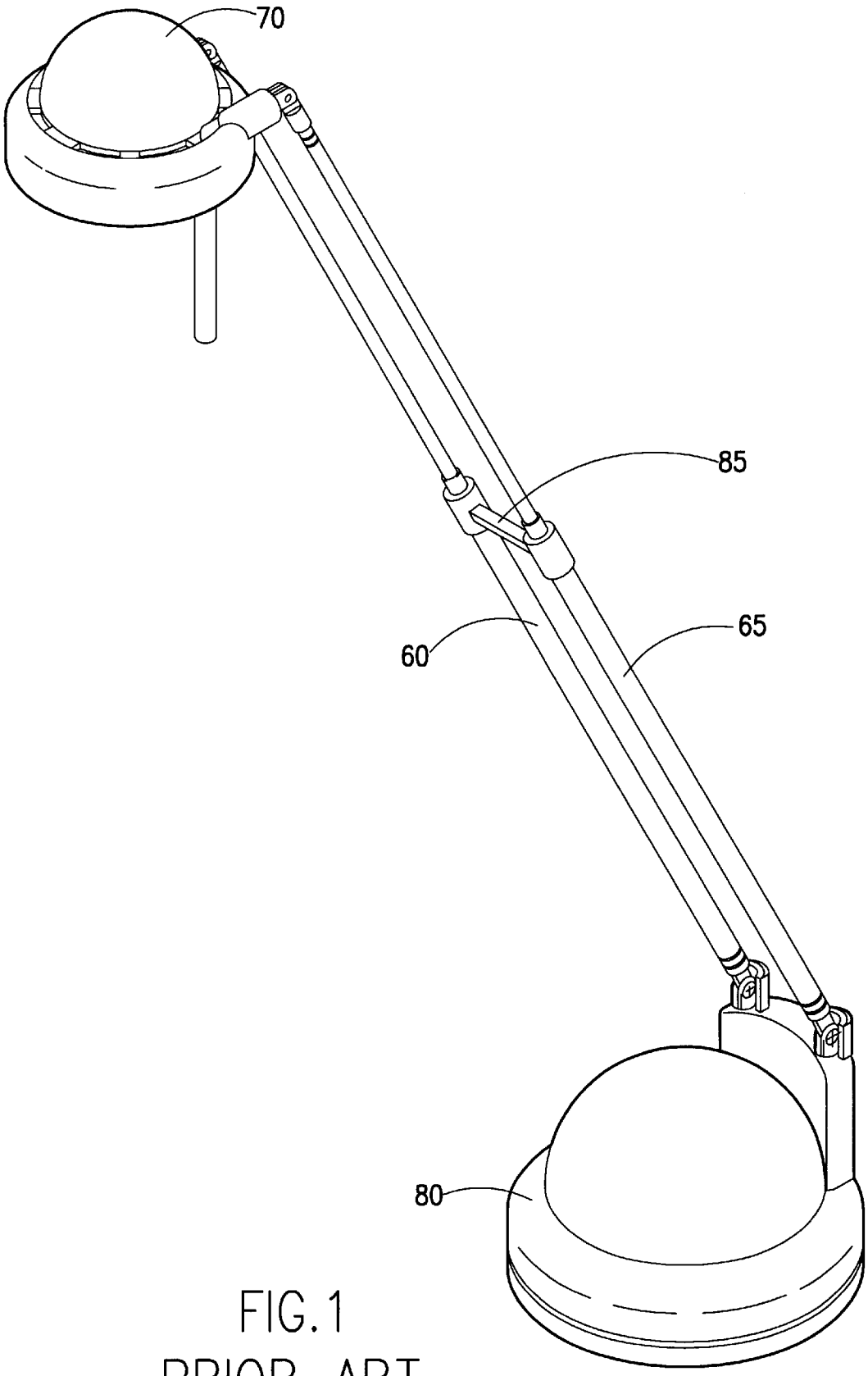
FIG. 1 PRIOR ART
FIG. 1 shows the appearance of a prior art two rods type lamp.
Figure 2:
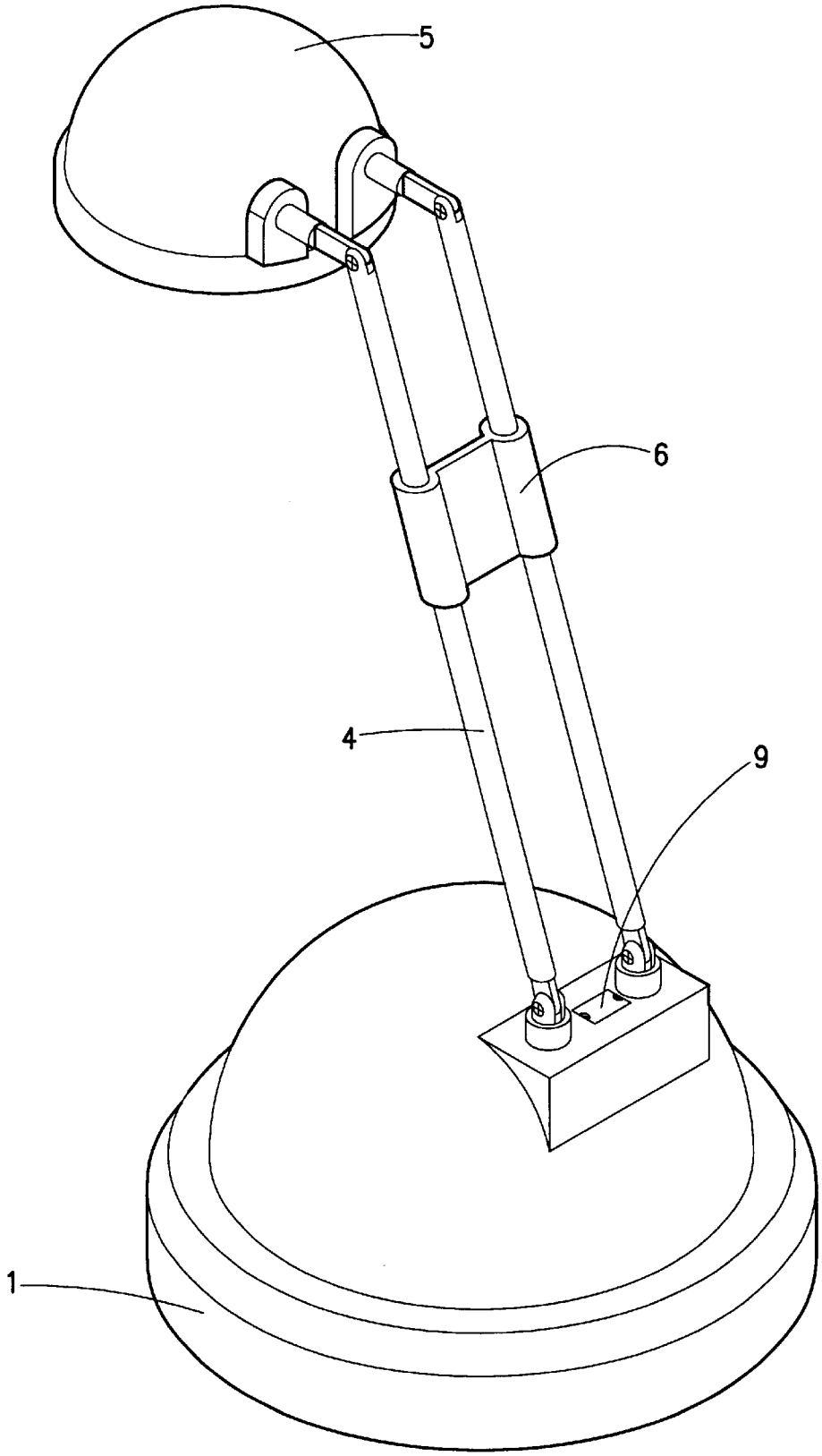
FIG. 2 shows the appearance of the present invention.
Figure 3:
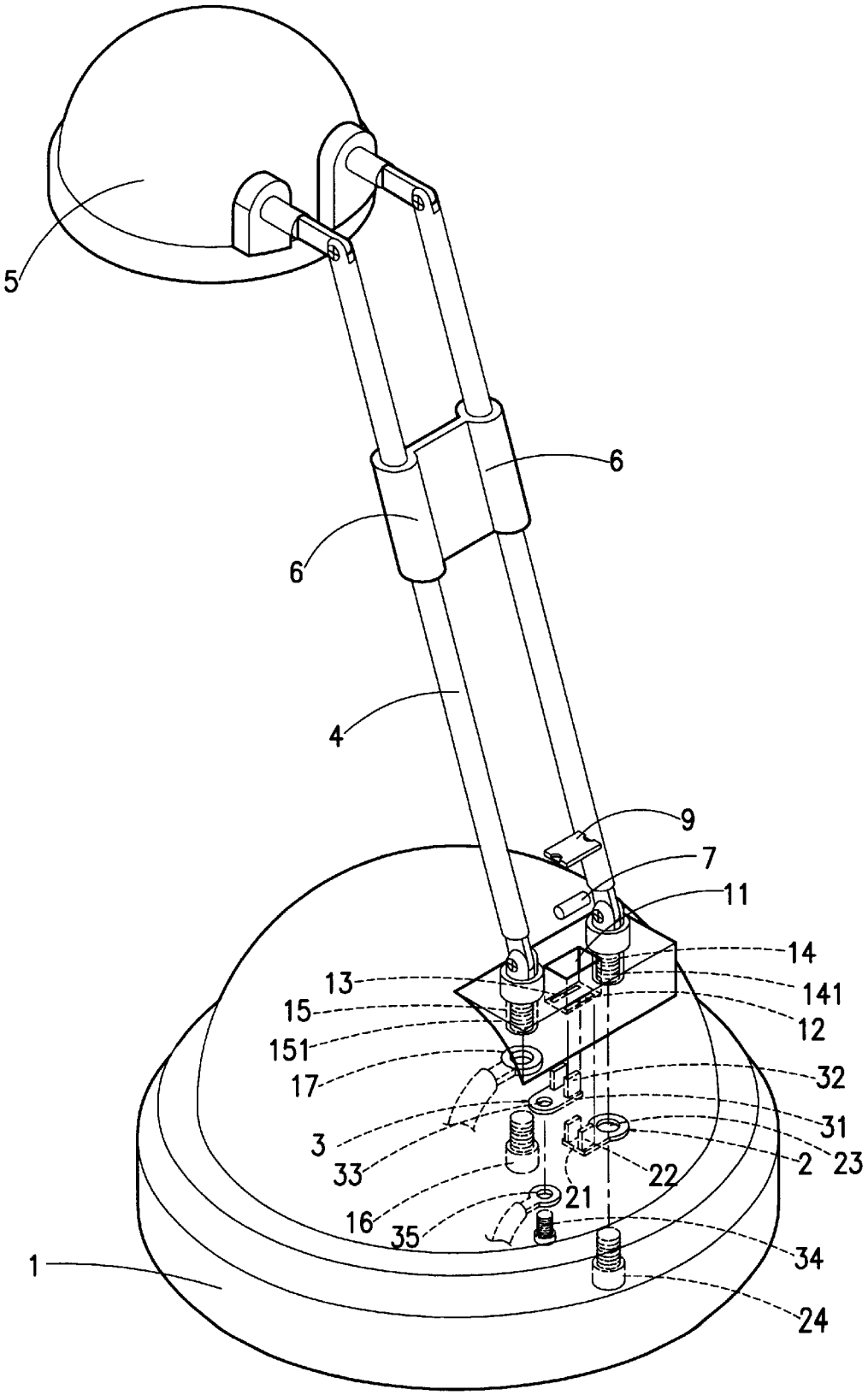
FIG. 3 is an exploded view of the present invention.
Figure 4:
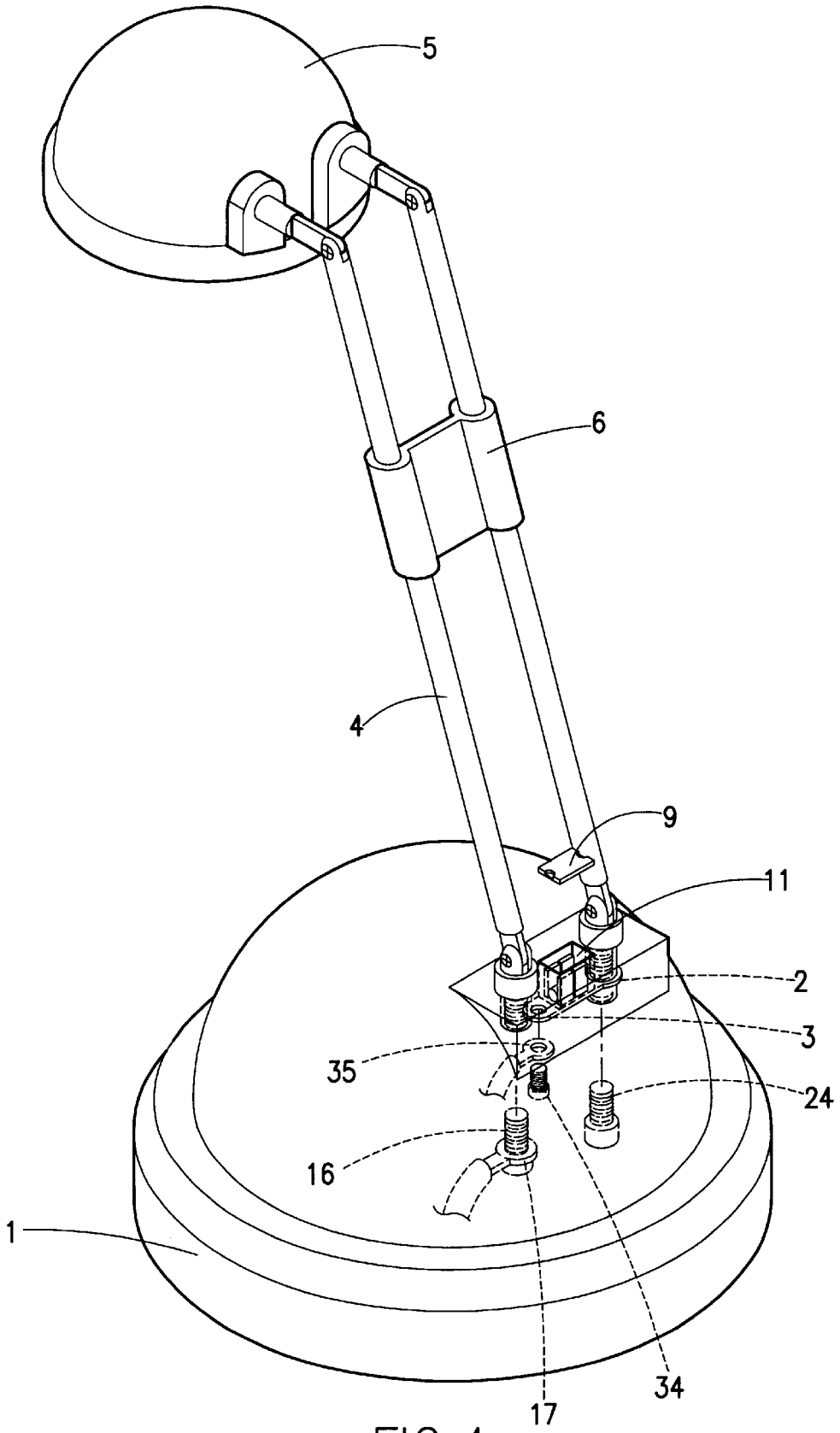
FIG. 4 is a sectional exploded view of the present invention.
Figure 5:
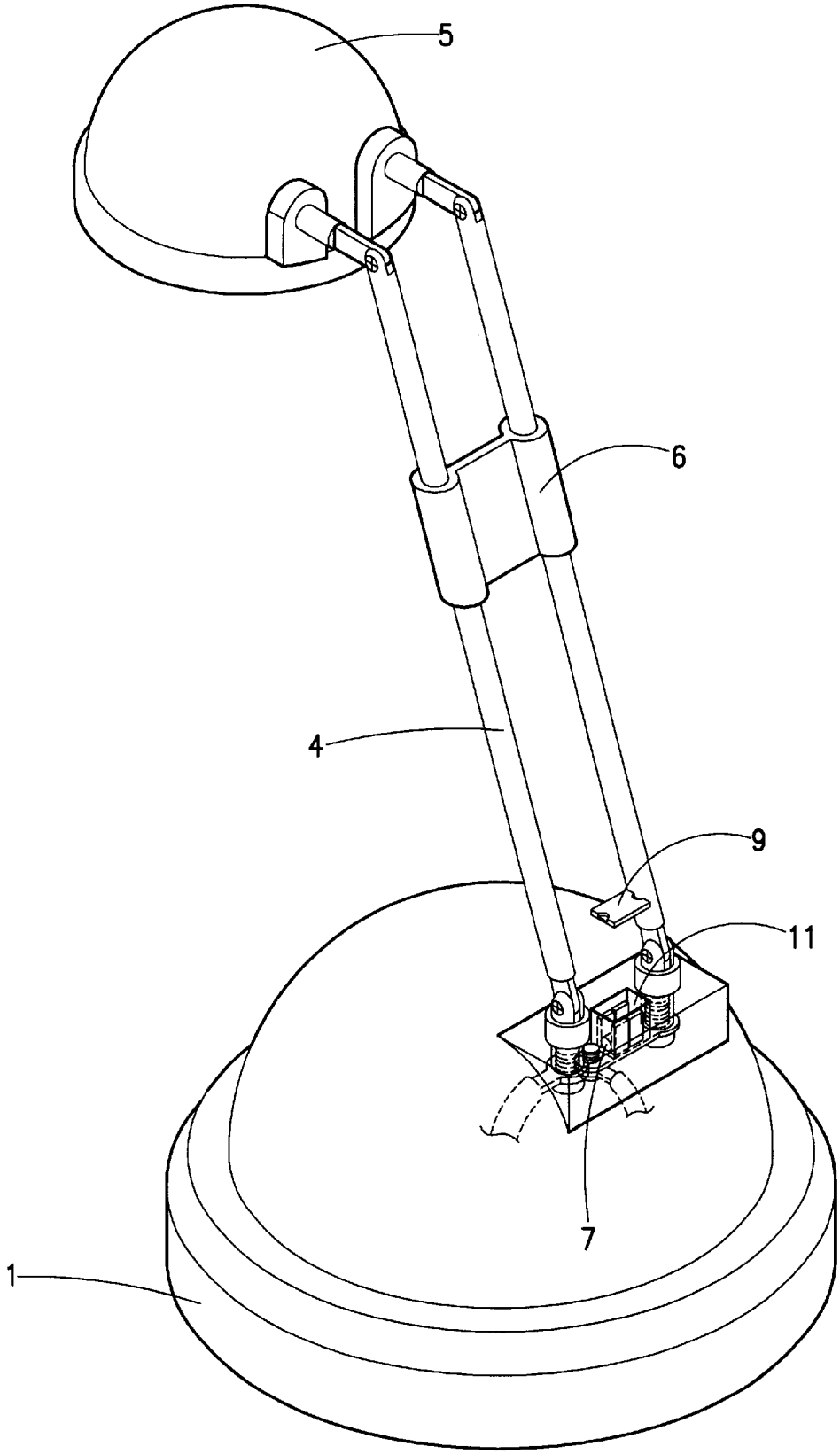
FIG. 5 is an assembled view of the present invention.
Figure 6:
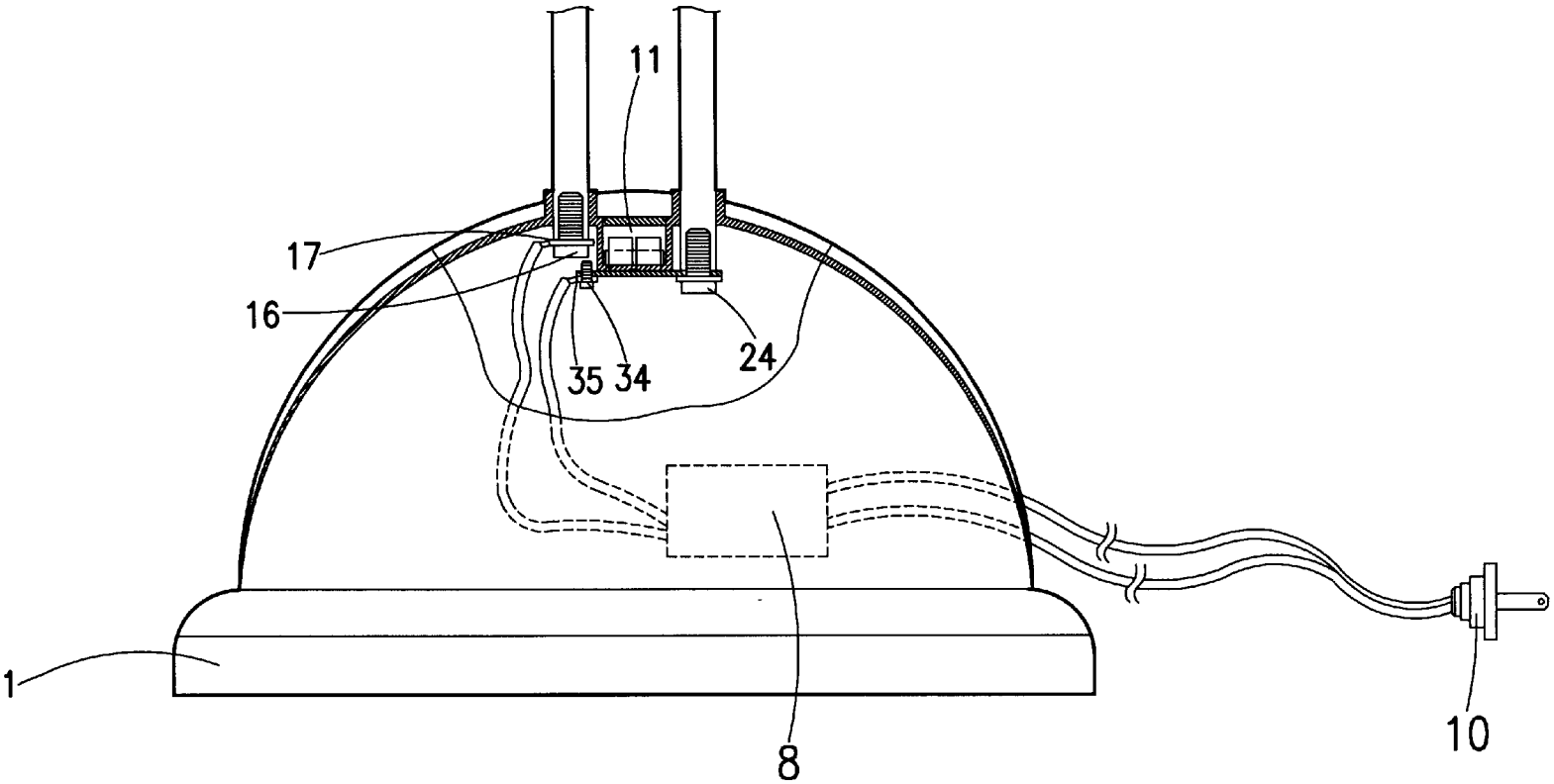
FIG. 6 is cross sectional view of the present invention.

As shown in FIGS. 2~6, the protecting device of a desk lamp of the present invention includes a seat 1, two clamping pieces 2, 3, two parallel conductive telescopic rods 4, a lamp head 5, an insulating stopper 6, a fuse wire 7, a transformer 8, a cover 9, etc.

The seat 1 has a cambered shape and a transformer is installed therewithin. Two primary sides of the transformer are connected via a receptacle 10 to 9 power source. A guide groove 11 is formed on the cambered surface of the seat 1. Two adjacent trenches 12 and 13 are formed on the recessed surface of the guide groove 11 to be engaged by two clamping pieces 2 and 3 from the seat 1. Fixing rods 14 and 15 are embedded on two sides of the guide groove 11. The lower portions of the fixing rods 14 and 15 are formed with internally threaded bore 141 and 151, respectively. The lower end of one of the fixing rods 15 is passed through a ring 17 to threadedly engage the internally threaded bore 151. The ring 17 is connected on the primary side of the transformer 8. The upper ends of the fixing rods 14 and 15 are pivotally connected with two parallel telescopic rods 4. The upper ends of the two telescopic rods are pivotally connected with bulbs (not shown) in the lamp head 5. An insulating stopper 6 is connected between the two telescopic rods 4 in order to prevent the contact of the two telescopic rods 4 during twisting and to limit the adjusting range of the lamp head 5 so that the present invention has the function of positioning in the front and rear directions.

Receiving portions 21 and 31 are installed with clamping pieces 2 and 3, respectively. Each of the receiving portions 21 and 31 is installed with respective guide portions 22 and 32 and respective receiving holes 23 and 33. A screw 24 penetrates through the receiving hole 23 of the first clamping piece 2 to lock into the internally threaded bore 141 in the lower portion of the fixing rod 14. Thus, the guide portion of the clamping piece 2 may engage with respective trenches 12 from the seat 1. The receiving hole 33 of the clamping piece 3 is lockingly engaged by a screw 34 that penetrates through a ring 35. The guide portion 32 engaged with respective trenches 15 and a filament is connected between the two clamping pieces 2 and 3.

When the power plug 10 is inserted into a power receptacle, the power supplied by the transformer 8 will pass through one of the clamping pieces 3, the filament 7, the fixing rods 14 and 15, the telescopic rods 4 to the lamp head 5 so that he bulb will light. Then, if the two telescopic rods 4 are destructively contacted unintentionally (for example, two connecting rods are twisted so that the two telescopic rods are contacted with each other or a metal piece is contacted concurrently with the two connecting rods) so as to short the two telescopic rods, then the fuse wire 7 will burn out and the transformer is therefore prevented from being burned out.

Figure 7:
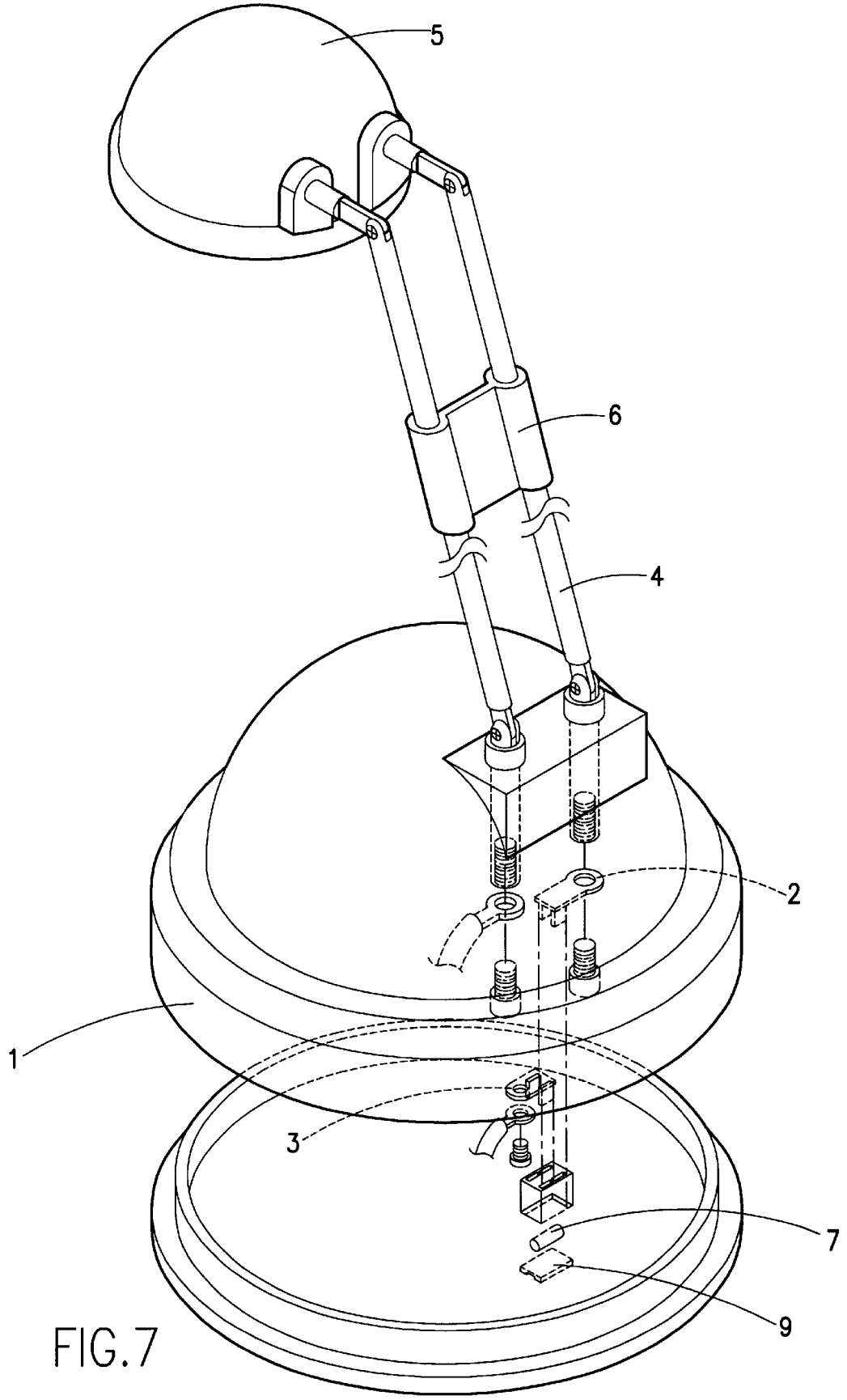
FIG. 7 is an exploded view of another embodiment of the present invention.
Figure 8:
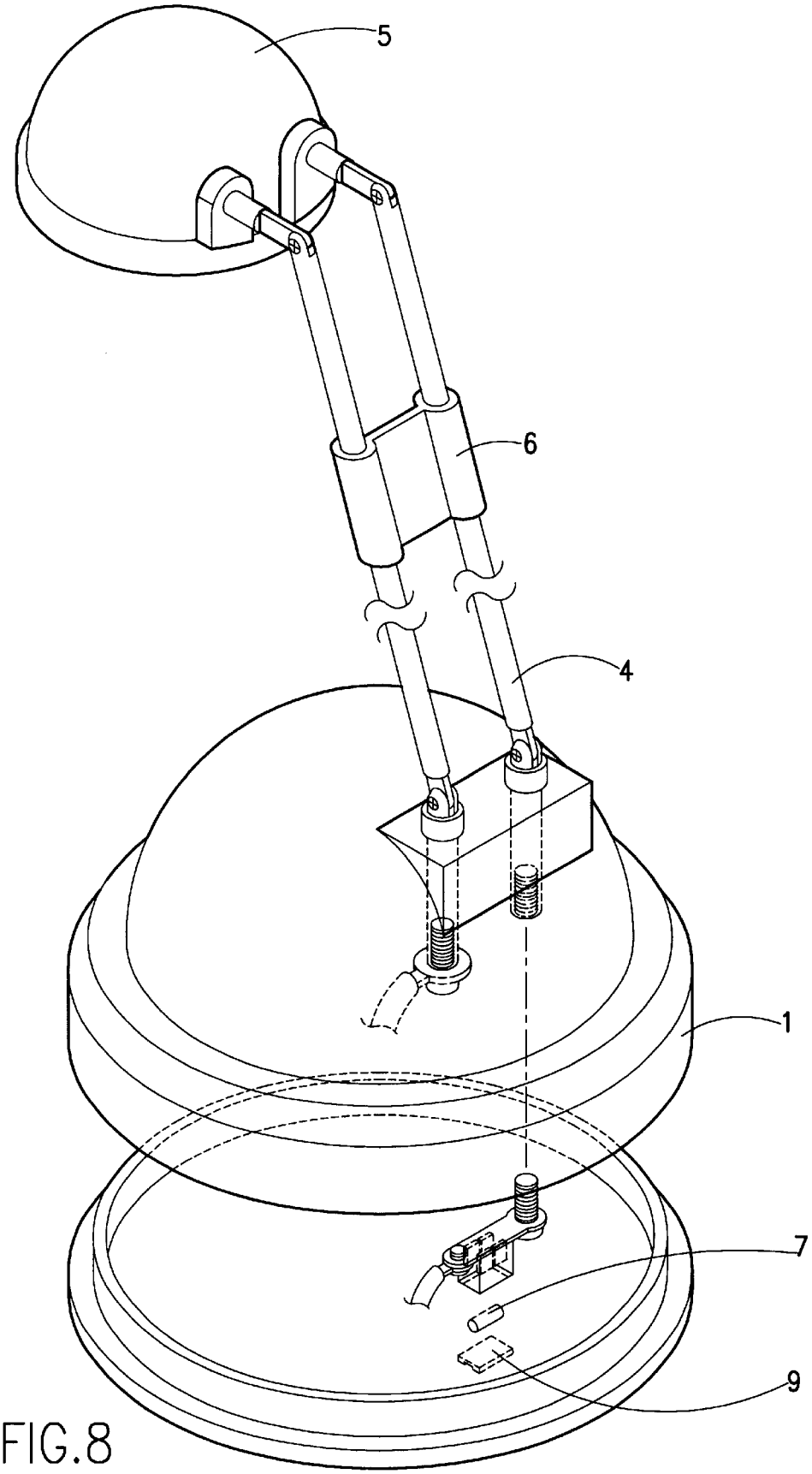
FIG. 8 is a sectional exploded view showing the assembling of another embodiment of the present invention.
Figure 9:
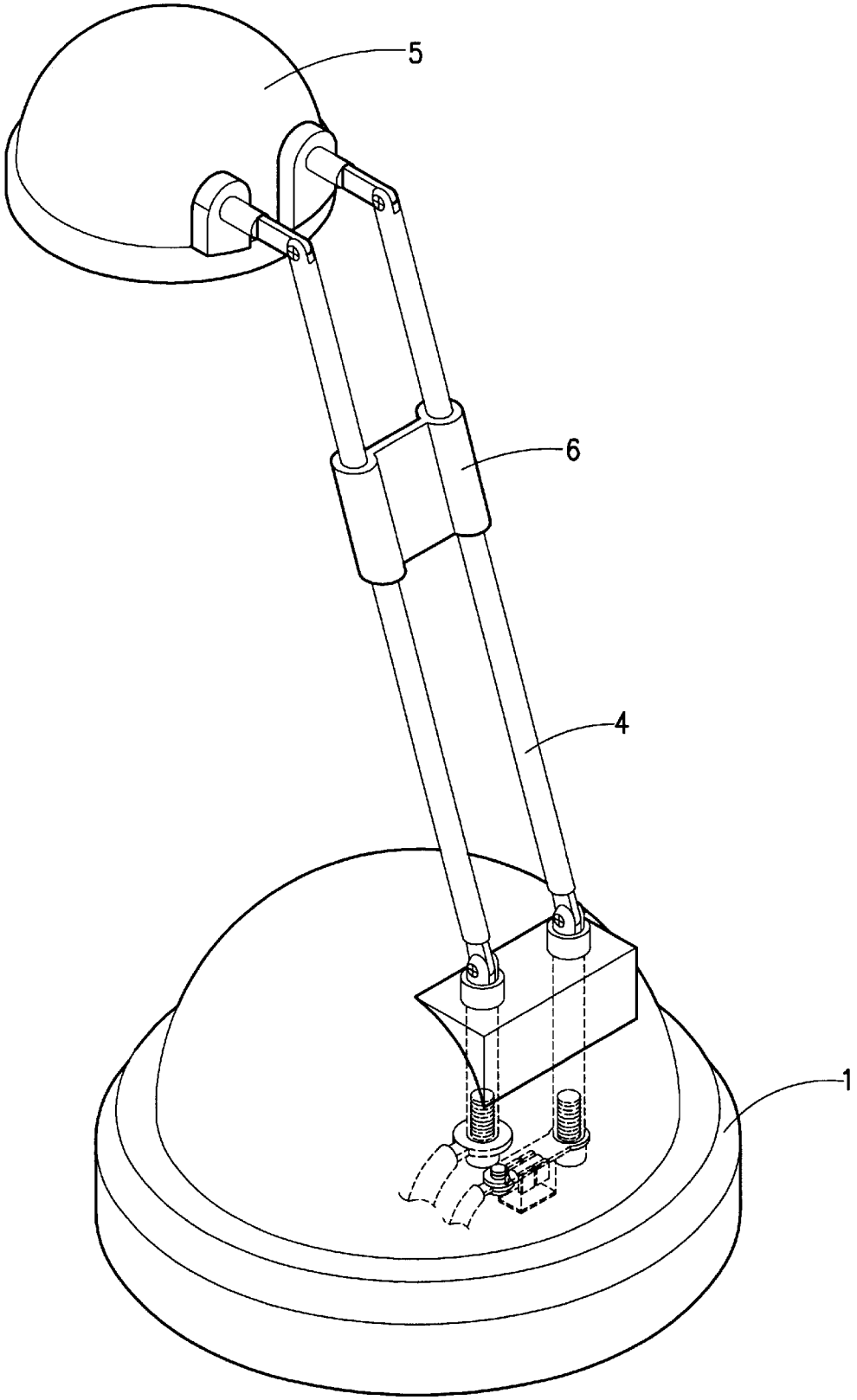
FIG. 9 is an assembly view of another embodiment of the present invention.

Moreover, referring to FIGS. 7 and 9, in the present invention, the aforementioned components (the two clamping pieces 2, 3, the filament 7, cover plate 9) can be assembled therewithin from the lower cover so as to connect with the two telescopic rods and the transformer 8 (as FIG. 6) to form an integral body.

In summary, by the special design of the present invention, the two telescopic rods can be prevented from destructively contacting each other, and thus, the transformer can be prevented to burn out. Although the present invention has been described using specified embodiment, the examples are meant to be illustrative and not restrictive. It is clear that many other variations would be possible without departing from the basic approach, demonstrated in the present invention.

Description of the Numerals in Figures

| | | | |
|---|---|---|---|
| 1 | Seat | 4 | Telescopic rod |
| 11 | Guide groove | 5 | Lamp head |
| 12, 13 | Trench | 6 | Insulatig stopper |
| 14, 15 | Fixing rod | 7 | Filament |
| 141, 151 | Inner thread hole | 8 | Transformer |
| 16 | Screw | 9 | Cover plate |
| 17 | Ring | 10 | Power plug |
| 2, 3 | Clamping piece | | |
| 21, 31 | Receiving portion | 24, 34 | Screw |
| 22, 32 | Guide groove | 35 | Ring |
| 23, 33 | Receiving hole | | |

What is claimed is:

1. A protection system for a desk lamp comprising:

(a) a seat having formed therein at least first and second fixing rod portions and a guide groove portion disposed therebetween, said guide groove portion defining a recessed surface having a plurality of trenches formed therein;

(b) at least a pair of conductive telescopic rods respectively coupled in pivotal manner to said fixing rod portions of said seat to extend substantially in parallel therefrom to a lamp head;

(c) a transformer disposed within said seat, said transformer having first and second primary ring terminals, said first primary ring terminal being coupled to said first fixing rod portion;

(d) at least a pair of clamping pieces engaging said trenches of said guide groove portion of said seat, said clamping pieces being coupled respectively to said second fixing rod portion of said seat and said second primary ring terminal of said transformer; and, (e) a fuse wire member disposed in said guide groove portion of said seat, said fuse wire member protectively coupling said clamping pieces one to the other.

2. The protection system as recited in claim 1 wherein each of said clamping pieces includes a receiving portion extending from a guide portion, said receiving portion having a receiving hole formed therein, said guide portion having a pair of guide pieces projecting therefrom.

3. The protection system as recited in claim 2 wherein said guide pieces of one said clamping piece guide portion pass respectively through a first adjacent pair of said guide groove portion trenches and said guide pieces of another said clamping piece guide portion pass respectively through a second adjacent pair of said guide groove portion trenches.

4. The protection system as recited in claim 1 wherein each said fixing rod portion of said seat has formed therein a terminal end having an internally threaded bore.

5. The protection system as recited in claim 1 further comprising an insulating stopper coupled to said telescopic rods to extend between intermediate portions thereof.

6. The protection system as recited in claim 1 wherein said clamping pieces engage said trenches of said guide groove portion from below said recessed surface of said guide groove portion.

7. The protection system as recited in claim 1 wherein said clamping pieces engage aid trenches of said guide groove portion from above said recessed surface of said guide groove portion.

* * * * *